US007493773B2

(12) United States Patent
Beatenbough et al.

(10) Patent No.: US 7,493,773 B2
(45) **Date of Patent: *Feb. 24, 2009**

(54) REFRIGERANT MONITORING SYSTEM AND METHOD

(75) Inventors: John Bryan Beatenbough, Anderson, SC (US); Edward Rios, Hartwell, GA (US); Ryan Edward Haley, Hartwell, GA (US)

(73) Assignee: Emerson Retail Services, Inc., Kennesaw, GA (US)

( * ) Notice: Subject to any disclaimer, the term of this patent is extended or adjusted under 35 U.S.C. 154(b) by 208 days.

This patent is subject to a terminal disclaimer.

(21) Appl. No.: 11/153,796

(22) Filed: Jun. 15, 2005

(65) Prior Publication Data

US 2005/0229613 A1 Oct. 20, 2005

Related U.S. Application Data

(63) Continuation of application No. 10/848,764, filed on May 19, 2004, now Pat. No. 6,952,931.

(60) Provisional application No. 60/509,103, filed on Oct. 6, 2003.

(51) Int. Cl.
*F25B 45/00* (2006.01)

(52) U.S. Cl. ..... 62/149; 62/292; 62/77

(58) Field of Classification Search ..... 62/149, 62/282, 77, 125, 475, 293
See application file for complete search history.

(56) References Cited

U.S. PATENT DOCUMENTS

| | | | | |
|---|---|---|---|---|
| 3,163,015 | A | | 12/1964 | Spofford |
| 4,319,459 | A | | 3/1982 | Hannett et al. |
| 4,470,265 | A | | 9/1984 | Correia |
| 4,513,578 | A | * | 4/1985 | Proctor et al. ..... 62/149 |
| 4,624,112 | A | | 11/1986 | Proctor |
| RE32,451 | E | | 7/1987 | Proctor et al. |
| 4,700,549 | A | | 10/1987 | Biagini |
| 4,866,955 | A | | 9/1989 | Blair et al. |
| RE33,212 | E | | 5/1990 | Lower et al. |
| 5,172,562 | A | | 12/1992 | Manz et al. |
| 5,176,187 | A | | 1/1993 | Grant |
| 5,202,582 | A | | 4/1993 | Szynal et al. |
| 5,226,471 | A | | 7/1993 | Stefani |
| 5,377,493 | A | | 1/1995 | Friedland |
| 5,423,190 | A | | 6/1995 | Friedland |
| 5,493,869 | A | | 2/1996 | Shirley et al. |
| 5,713,213 | A | | 2/1998 | Nobuta et al. |
| 5,775,112 | A | | 7/1998 | Wilson |
| 5,797,436 | A | | 8/1998 | Phallen et al. |
| 5,802,859 | A | | 9/1998 | Zugibe |
| 6,134,896 | A | | 10/2000 | Brown et al. |
| 6,141,977 | A | | 11/2000 | Zugibe |
| 6,168,130 | B1 | | 1/2001 | Yokogi |
| 6,315,039 | B1 | | 11/2001 | Westbrooks, Jr. et al. |
| 6,609,381 | B1 | | 8/2003 | Morgan |
| 6,952,931 | B2 | | 10/2005 | Beatenbough et al. |

* cited by examiner

*Primary Examiner*—Chen Wen Jiang
(74) *Attorney, Agent, or Firm*—Harness, Dickey & Pierce, P.L.C.

(57) ABSTRACT

A system for monitoring the amount of refrigerant supplied from a refrigerant tank to a plurality of refrigerant systems comprising a tank valve for connection to a refrigerant tank at a predetermined location. A rack of refrigerant rack lines is routed from the location to the refrigerant systems for connecting the tank valve and refrigerant to the refrigerant systems. Rack valves are disposed in the refrigerant rack lines for controlling the flow of refrigerant through the rack lines to a selected refrigerant system. A sensor for determining the amount of refrigerant supplied from the refrigerant tank to a refrigerant system and recording the supplied amount of refrigerant. The system controller controls the rack valves and tank valve to selectively connect the supply of refrigerant in the refrigerating tank with a selected refrigerant system so that the amount of refrigerant delivered to the refrigerant system is recorded by the system controller.

16 Claims, 5 Drawing Sheets

REFRIGERANT MONITORING SYSTEM AND METHOD

CROSS REFERENCE TO RELATED APPLICATION

This application is a continuation of U.S. patent application Ser. No. 10/848,764, filed on May 19, 2004, now U.S. Pat. No. 6,952,931, issued Oct. 11, 2005, which claims the benefit of a provisional application filed Oct. 6, 2003, under Ser. No. 60/509,103, having the same title.

FIELD OF THE INVENTION

This invention is directed to a system and method for metering refrigerant in commercial refrigerant systems and the like, and more particularly, to a computerized system and method that uses an electronic scale to measure dispensed refrigerant and generate an accounting history of refrigerant used for refrigerant systems.

BACKGROUND OF THE INVENTION

The use of refrigerant systems for cooling of food and beverages in supermarkets and super stores, storage of food and materials in manufacturing and processing plants, etc. creates a major problem in maintaining the systems, and keeping the systems properly charged with a refrigerant. Release of the refrigerant into the atmosphere is detrimental to the environment and is a problem that needs to be regulated. The Environmental Protection Agency (EPA) is demanding more and more accounting of refrigerant quantities supplied and used by these large users in order to determine irregular consumption and possible refrigerant leakages.

Typically, when a refrigerant system needs more refrigerant, a technician comes with a tank of refrigerant and connects the tank to the refrigerant's system. Once the tank is connected, the system begins receiving refrigerant from the tank. The traditional method for measuring the amount of refrigerant that has been put into the system from the tank is the technician lifting the tank and estimating the weight of the refrigerant that has been entered into the system. While the inaccuracy that can exist from measuring refrigerant in this manner may seem insignificant, when looked at on a much larger scale it becomes much more significant. For example, a nationwide grocery store chain could have several hundreds of thousands of refrigerant systems. If that grocery store chain is over-paying by even a small amount per each system, then when multiplied by the hundreds of thousands of systems they have then it can be a quite significant amount.

Because of new federal accounting standards for the amount of refrigerant being placed into refrigerant systems, large companies need to have accurate numbers for how much refrigerant is being placed or lost in their systems on a daily basis. Having this accurate accounting will keep corporations from having problems or violations under the EPA. The accurate measurement and accounting will also allow corporations to determine if they have any leaks in their system and correct these leaks. Correcting these leaks not only cuts cost but is also of benefit to the environment.

Accordingly, an object of the present invention is to provide a system and method for accurately monitoring the amount of refrigerant put into a refrigerant system.

Another object of the present invention is to provide a system and method for accurately monitoring refrigerant that goes into multiple refrigerant systems.

Still another object of the present invention is to provide a system and method for accurately monitoring and accounting the amount of refrigerant put into a refrigerant system.

SUMMARY OF THE INVENTION

The above objectives are accomplished according to the present invention by providing a system for monitoring the amount of refrigerant used in refrigerant systems comprising a housing; and an electronic weight scale in the housing for supporting a refrigerant tank containing a supply of refrigerant and generating weight signals corresponding to the amount of refrigerant in the refrigerant tank. A tank valve is carried in the housing for connection to the refrigerant tank when placed on the weight scale. A refrigerant line rack includes a plurality of refrigerant rack lines routed from the housing to the refrigerant systems for connecting the tank valve to the refrigerant systems. Rack valves are disposed in the refrigerant rack lines for controlling the flow of refrigerant through the rack lines to a selected refrigerant system. A system controller is connected to the electronic scale for receiving the weight signals from the weight scale. The controller controls the rack valves and tank valve to selectively connect the supply of refrigerant in the refrigerating tank with a selected refrigerant system so that the amount of refrigerant delivered to the refrigerant system is recorded by the system controller. An input device is provided for inputting data into the controller. A display is in communication with the controller for displaying the charging process and the current quantity of refrigerant in the tank. The housing includes a door moveable between an open position and a closed position; and includes a door sensor for determining whether the door is closed to generate a door closed signal.

The controller includes a computer readable medium, and a computer program residing in the computer readable medium having operating instructions for operating the system during the refrigerant charging process. The operating instructions include instructions for preventing the operation of the system unless a door closed signal is received by the controller. The operating instructions include (1) instructions for recording the amount of refrigerant indicated by the weight signal along with the time and date of the delivery of refrigerant to the refrigerant system; (2) instructions for receiving a selection signal indicating which rack line to supply refrigerant through instructions for opening a rack valve corresponding to the rack line desired to be charged with refrigerant; (3) instructions for opening the tank valve; (4) instructions for receiving the weight signal of the refrigerant being supplied through the rack line; and (5) instructions for closing the tank valve and the selected rack valve in response to receiving a stop signal, and recording the final weight signal at the time the stop signal is received. The computer program further includes instructions for storing and displaying an initial weight signal prior to opening the rack valve and the tank valve, for storing and displaying the final weight, and for processing the initial and final weight signals to determine the amount of refrigerant delivered to the refrigerant system. A transaction file is created after the process containing the amount of refrigerant delivered to the refrigerant system, and the time and date of the delivery, which is stored on a system server.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
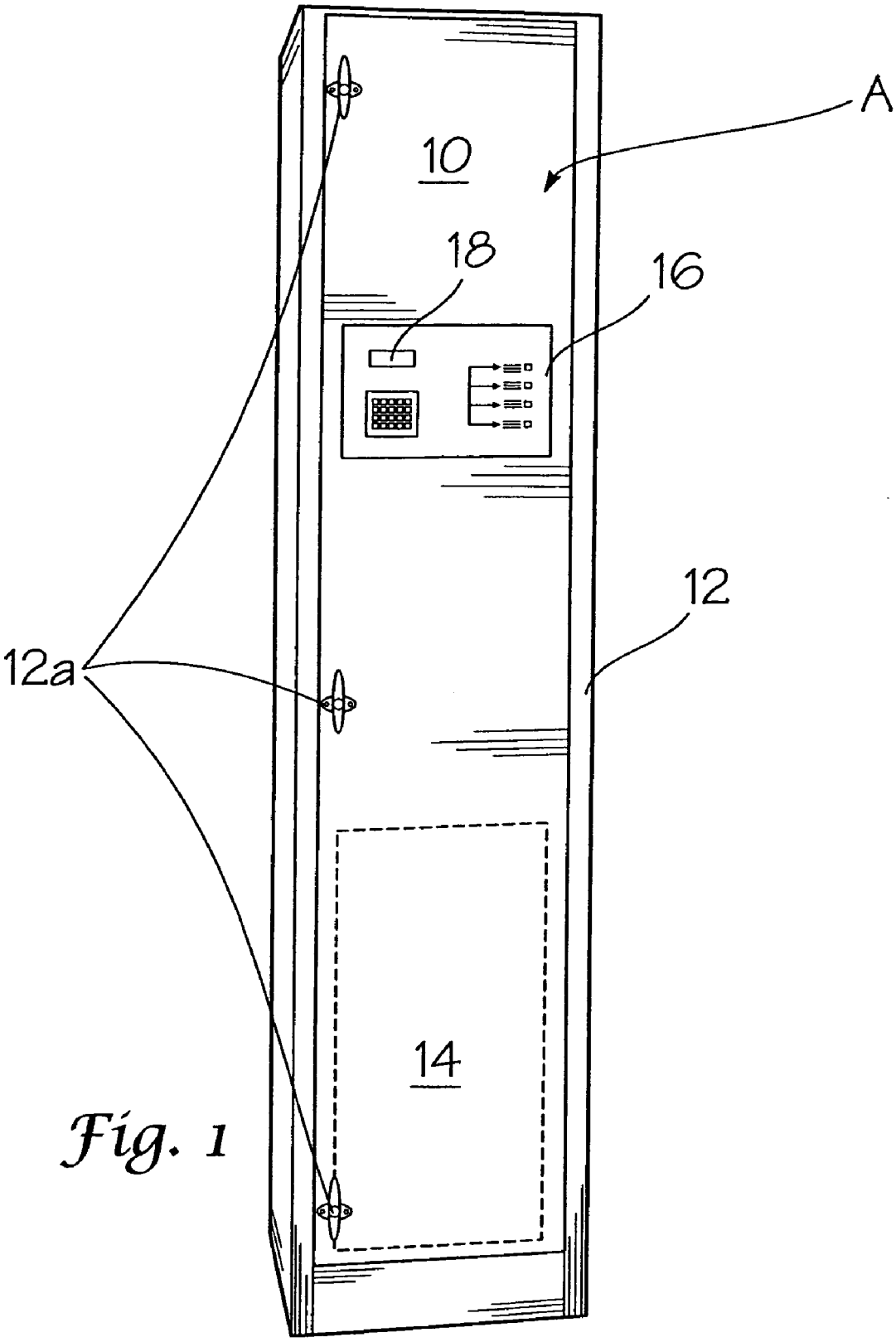
FIG. 1 illustrates a front elevation of a housing for a refrigerant measuring and accounting system according to the invention.

Referring now to the drawings, the invention will now be described in more detail. FIG. 1, illustrates a cabinet housing 10 for a computerized refrigerant measuring and accounting system, designated generally as A, according to the invention. The cabinet housing includes a door 12, with handles 12*a*, on measurement compartment 14, and a control panel 16 having a display 18.

Figure 2:
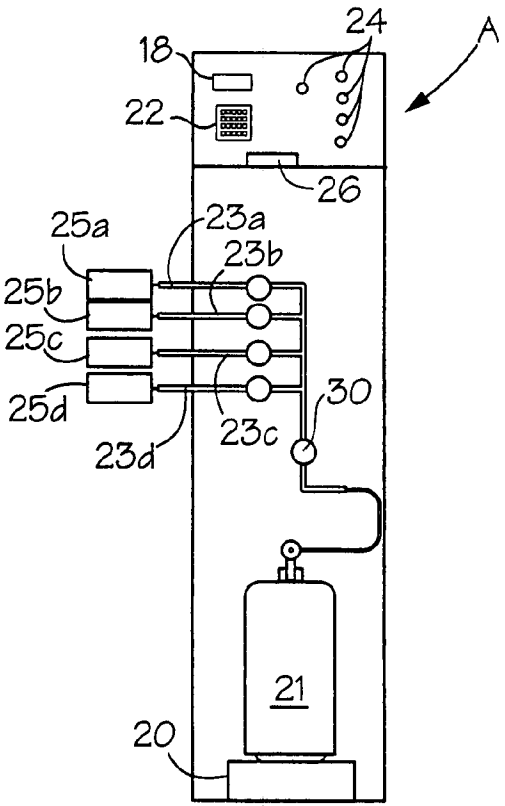
FIG. 2 is a schematic of the front view of the system with the door removed.
Figure 4:
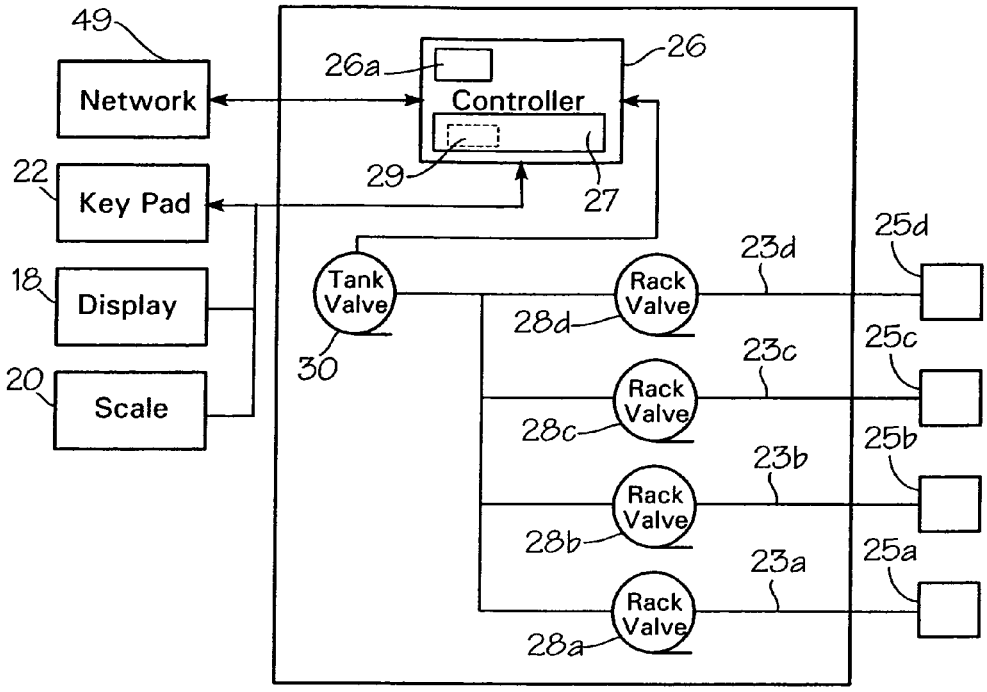
FIG. 4 is a block diagram of a refrigerant monitoring system according to the invention.

As can best be seen in FIG. 2, with door 12 removed, measurement compartment 14 includes a weight scale 20. A refrigerant container 21, is supported on the scale. There are a plurality of refrigerant lines 23*a*, 23*b*, 23*c*, and 23*d* connected to a plurality of refrigerant systems 25*a*, 25*b*, 25*c*, and 25*d*, respectively. Display 18 provides the user information regarding the activity of the system, and prompts the user to make inputs on keypad 22. The display shows the charging process and the current weight on the scale. Keypad 22 is the illustrated manner in which the user of the system communicates with the system. Indicators 24 show the user which system, 25*a*-25*d*, is being charged and if the system is operating. Refrigerant monitoring system (RMS) controller 26 receives input from keypad 22 and controls rack valves 28*a*, 28*b*, 28*c*, and 28*d* and tank valve 30 accordingly. System controller 26 handles the communication, operation, and logical control of the system. For this purpose, a program containing a set of computer readable instructions 29 is stored in a computer readable medium 27 of controller 26 (FIG. 4). The controller further includes an SI card 26*a* which powers and calibrates the reading of scale 20. The card is wired to the controller to send a 0-10 vdc signal to the controller based on the weight on the scale. Depending on user input on keypad 22, RMS controller 26 opens rack valve 28*a*, 28*b*, 28*c*, or 28*d*, and tank valve 30, or closes rack valves 28*a*-28*d* and tank valve 30. If the user wishes to put refrigerant into refrigerant system 25*a* that is connected to rack valve 28*a*, then the user would input this request on keypad 22. Keypad 22 also inputs a ticket number. Controller 26 receives this input and transmits information to rack valve 28*a* causing it to open. Then, controller 26 would cause tank valve 30 to open. This would allow refrigerant to flow from the refrigerant tank through tank valve 30 through rack valve 28*a* while maintaining the other valves closed. During the process of delivering refrigerant to the systems, the refrigerant tank 21 is supported on scale 20.

Figure 3:
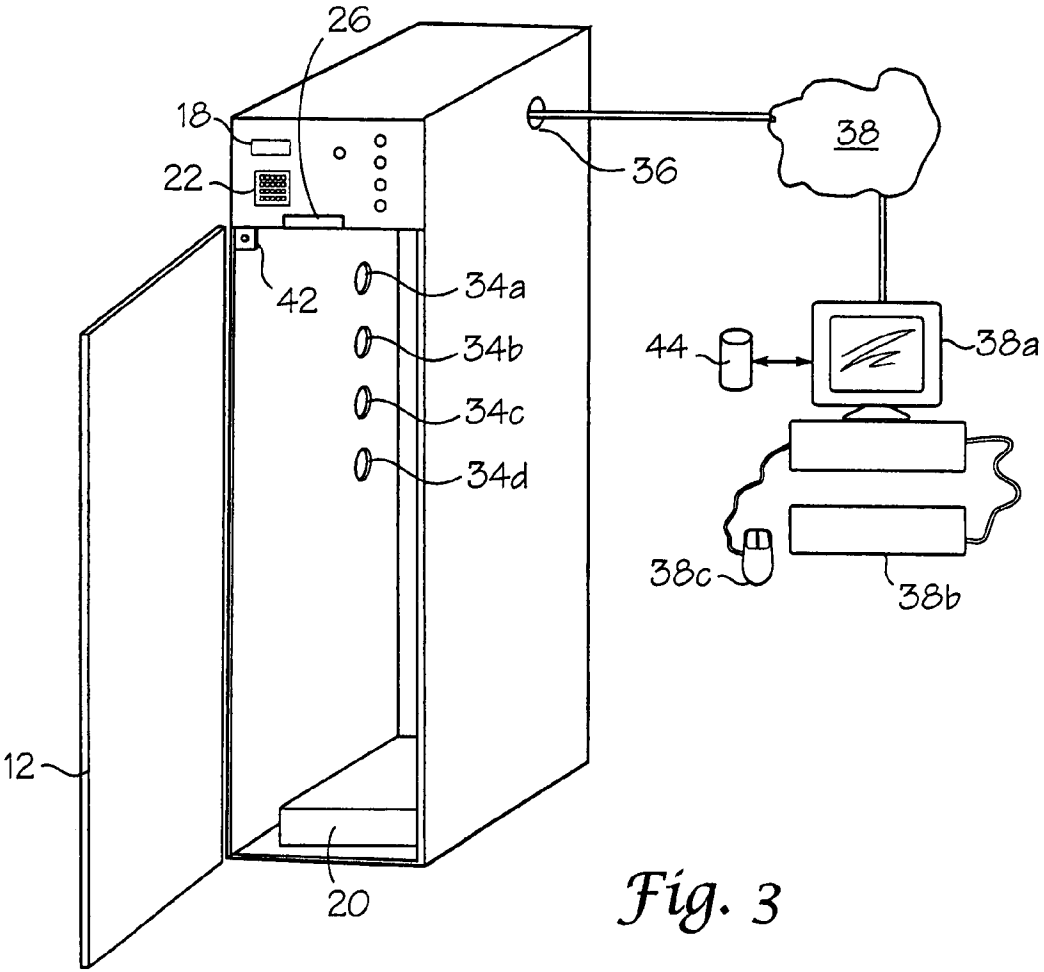
FIG. 3 is a schematic of the isometric view of the system with the door of the housing in an open position.

FIG. 3 is an isometric view of the system A shown in FIG. 2. FIG. 3 shows display 18, keypad 22 and scale 20 as in FIG. 2, and holes 34*a*, 34*b*, 34*c*, and 34*d* for rack plumbing 23*a*-23*d*. The plumbing connected to refrigerant tank exits through these holes and is routed to its respective refrigerant system 25*a*-25*d*. For example, the plumbing exiting hole 34*a* goes to rack 23*a* to provide refrigerant to refrigerant system 25*a*. Also shown on FIG. 3 is the entrance and exit for power and network connections 36. Through exit hole 36 the power cord which gives power to the controller 26 and any network cable connecting controller 26 to an outside network 38 having a remote computer terminal 38*a*, keyboard or other input device 38*b*, and/or mouse device 38*c* can be fed through the cabinet.

Referring now to FIG. 4, a more detailed drawing is presented showing the interaction between controller 26, keypad 22, tank valve 30, rack valves 28*a*-28*d*, and network hub 49. As can be seen, when a user of the system wishes to begin transferring refrigerant into a system, his input on keypad 22 goes directly to controller 26. Controller 26 controls tank valve 30 and one or more rack valves 28*a*-28*d*. Controller 26 upon proper input from keypad 22 first opens tank valve 30 which allows refrigerant to pass into one or more refrigerant systems 25*a*-25*d*. Then, according to user's input at keypad 22 one or more of the rack valves 28*a*-28*d* is opened. This causes refrigerant flowing through tank valve 30 to flow to the appropriate rack valve, for example rack valve 28*b*.

Figure 4A:
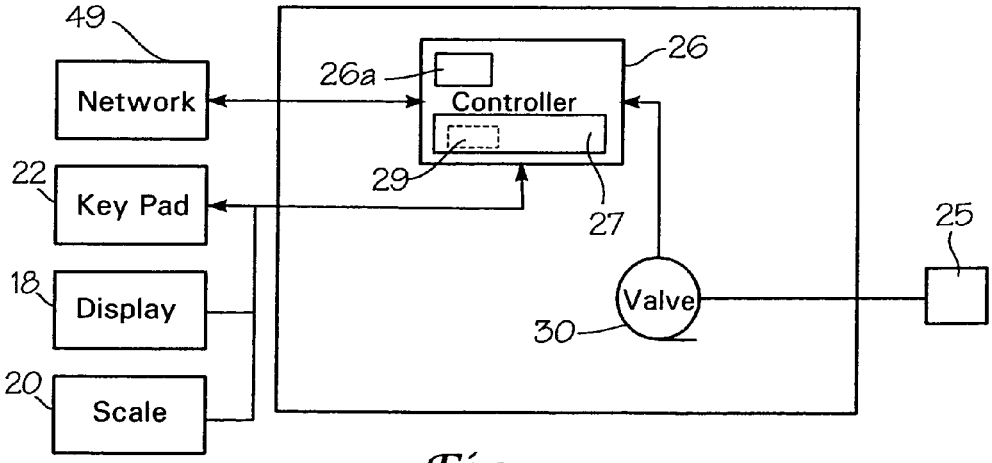

Referring now to FIG. 4*a*, an alternative embodiment of the invention is shown. This embodiment does not use a rack of valves for allowing multiple systems to receive refrigerant from one tank. Rather this system has the same components of a controller, scale, display, keypad, network capabilities, and one valve only. In this embodiment the refrigerant delivery and monitoring system would be a portable system that could be taken from location to location to charge multiple refrigerant systems. Note that in this and all other embodiments the term refrigerant systems should not be construed narrowly to only include refrigerant systems. Rather this term should be construed to define all systems using refrigerant including but not limited to refrigerant systems including HVAC systems. This alternative embodiment can be used to charge different refrigerant systems in different locations, or alternatively it can be located for just one refrigerant system in the case of a smaller company. Smaller companies may only need to have their refrigerant charged in one line or one system, and this embodiment of the invention would be preferable in this situation as a more cost effective and size efficient system.

The detailed description that follows may be presented in terms of program procedures executed on a computer or network of computers. These procedural descriptions are representations used by those skilled in the art to most effectively convey the substance of their work to others skilled in the art. These procedures herein described are generally a self-consistent sequence of steps leading to a desired result. These steps require physical manipulations of physical quantities such as electrical or magnetic signals capable of being stored, transferred, combined, compared, or otherwise manipulated by a set of computer readable instructions embodied in a computer readable medium that is designed to perform a specific task or tasks. Actual computer or executable code or computer readable code may be contained within one file or one storage medium but may also span several computers or storage mediums. The term "host" and "server" may be hardware, software, or a combination of hardware and software that provides the functionality described herein.

The present invention is described below with reference to flowchart illustrations of methods, apparatus ("systems") and computer program products according to the invention. It will be understood that each block, or step of a flowchart illustration can be implemented by a set of computer readable instructions or code. These computer readable instructions may be loaded onto a general purpose computer, special purpose computer, or other programmable data processing apparatus to produce a machine such that the instructions will execute on a computer or other data processing apparatus to create a means for implementing the functions specified in the flowchart block or blocks.

These computer readable instructions may also be stored in a computer readable medium that can direct a computer or other programmable data processing apparatus to function in a particular manner, such that the instructions stored in a computer readable medium produce an article of manufacture including instruction means that implement the functions specified in the flowchart block or blocks. Computer program instructions may also be loaded onto a computer or other programmable apparatus to produce a computer executed process such that the instructions are executed on the computer or other programmable apparatus provide steps for implementing the functions specified in the flowchart block or blocks. Accordingly, elements of the flowchart support combinations of means for performing the special functions, combination of steps for performing the specified functions and program instruction means for performing the specified functions. It will be understood that each block of the flowchart illustrations can be implemented by special purpose hardware based computer systems that perform the specified functions, or steps, or combinations of special purpose hardware or computer instructions. The term media is used to include audio, video, animation or any other form audio or visual information. The present invention is now described more fully herein with reference to the drawings in which the preferred embodiment of the invention is shown. This invention may, however, be embodied in many different forms and should not be construed as limited to the embodiment set forth herein. Rather, these embodiments are provided so that this disclosure will be thorough and complete and will fully convey the scope of the invention to those skilled in the art.

Figure 5:
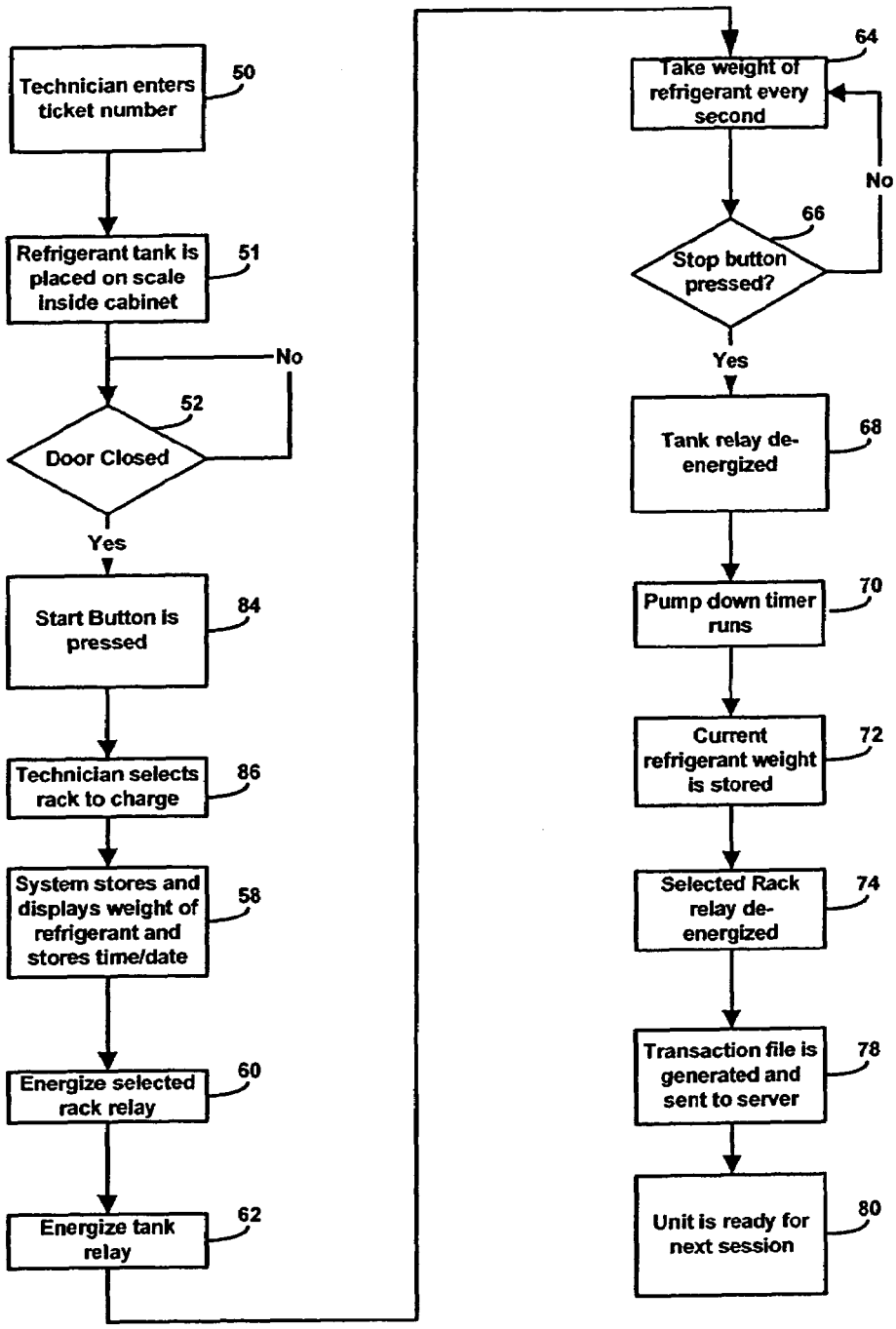
FIG. 5 is a flow chart of the operation of the refrigerant monitoring system according to the invention.

Referring now to FIG. 5, a flow chart of the system and method is shown. At step 50, the technician enters a ticket number. At step 51, a refrigerant tank is placed on scale 20 in the cabinet. For the system to work the refrigerant tank must be placed on the scale inside the cabinet. At step 52, the system makes a determination if the door of the cabinet is closed. If the door is not closed at step 52 then the system continues to loop until the door is closed. For this purpose, a door closed sensor 42 is provided and is connected to controller 26. If the door is closed, the technician presses the start button at step 54. At step 56, the technician selects a rack line to charge. The technician chooses between lines 23*a*-23*d* in this embodiment. In alternative embodiments, there could be 1, 2, or any number of racks the technician could choose from. At step 58, the system stores and displays the weight of the refrigerant in container 21 and stores the current date and time. These functions are achieved through RMS controller 26. At step 60, controller 26 energizes the selected rack relay valve 28*a*-28*d*. This would correspond to the selection made by the technician. For example, if the user had selected line 23*a*, then valve 28*a* would be energized. The rack valves are solenoid valves, thus when they receive energy they open or close depending on their current state. At step 62, the tank valve is energized. As in the rack valve, the energizing causes this valve to open if it was previously closed. At step 64, the system measures the weight of the refrigerant tank every second. The system continues to do this unless at step 66 the stop button is pressed. If the stop button is not pressed at 66, the system loops back to step 64 where it continues to take the weight of the refrigerant tank every second. If the stop button is pressed at step 66, then tank relay valve 30 is de-energized at step 68. This causes the valve to close. Then at step 70, a pump down timer runs. The purpose of the pump down timer is to allow any refrigerant that had entered through tank valve 30 but did not flow through rack valve 28*a*, for example, to pump into the system and prevent the line from clogging. At step 72, the current refrigerant tank weight is stored. Once step 72 is complete, then at step 74 the selected valve is de-energized, thus closing that rack valve. Note that in alternative embodiments the refrigerant weights can be measured before the pump down timer runs. The system then goes to step 78 where a transaction file is generated and sent to the server 38*a* via network connection 38. At step 80, the unit is ready for more transfer of refrigerant.

Figure 6:
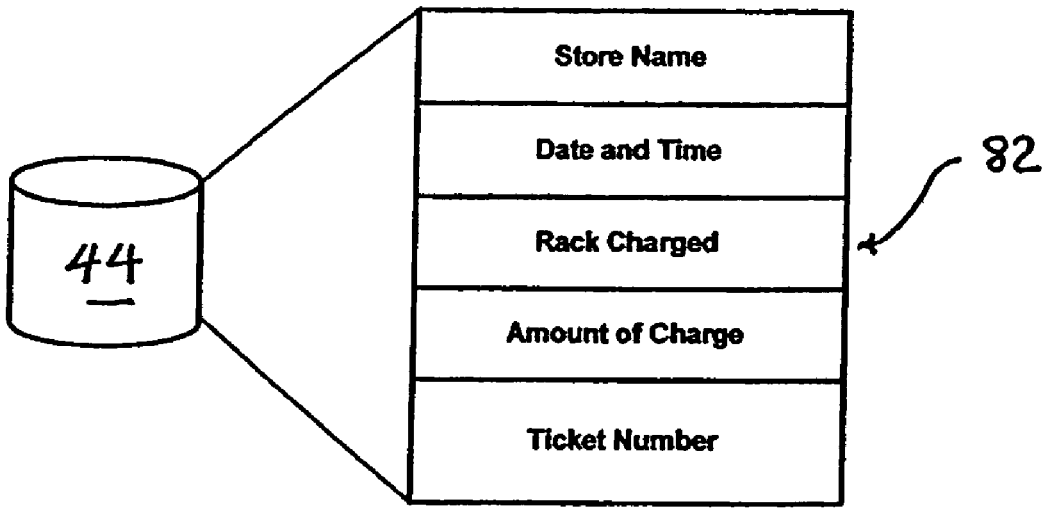
FIG. 6 is a schematic illustration of a transaction file according to the invention.

Each time refrigerant is added to a refrigerant system 25*a*-25*d*, the amount of refrigerant, and other related data, is stored in database 44. The database 44 is in communication with the computer server 38*a*. As such, the computer server 38*a* may read the data stored in the database 44 such that data is transferred between the computer server 38*a* and the database 44 (FIG. 3). Server 38*a* may be provided with a keyboard 38*b* and mouse input 38*c*. An example of a refrigerant system transaction file 82 is shown in FIG. 6. As is shown, it includes the store name, the date and time of the operation, the identity of the system charged, the amount of refrigerant used in the charge, and the ticket number. The data may be stored "for any periodic" or other reporting basis and may be stored for the life to the refrigerant system. Reports may be displayed or printed at server 38*a*. Placing the information into a database allows the user of the system easy access to the history of the refrigerant system for providing accounting reports to regulatory agencies and others.

The RMS system can communicate directly onto the internet and provide web pages for access and viewing the systems operation. In most cases, the RMS unit will plug into the stores Local Area Network (LAN) via the stores network HUB and communicate to a database server on the customer's Wide Area Network (WAN). When installed on the customer's network, the RMS Controller can use an IP address and a POSTING IP address or URL for the database server. The database server will then use the RMS information for reporting, alarming, bill verification, etc.

Note that an alternative embodiments the RMS system can have local storage of all data rather than transmitting the data over a network connection. As described above, there are situations where only one rack must be charged with refrigerant, in these situations it may be preferable for a smaller entity to maintain their information locally on the RMS system or on an associated computer. Also, the RMS device may use a database server as described above or it may simply e-mail the data collected during charging to a desired e-mail address. Upon receiving the e-mail containing the data, the recipient may parse the data into a readable format and have available verifiable reports of all charges made and all refrigerant used.

While a preferred embodiment of the invention has been described using specific terms, such description is for illustrative purposes only, and it is to be understood that changes and variations may be made without departing from the spirit or scope of the following claims.

What is claimed is:

1. A system for monitoring the amount of refrigerant supplied from a refrigerant tank to a refrigerant system comprising:

a housing for receiving a refrigerant tank;

a supply line for delivering refrigerant from the refrigerant tank to an identified refrigerant system;

a tank valve connected to said supply line and connectable to the refrigerant tank when the refrigerant tank is received in said housing for controlling delivery of the refrigerant;

said tank valve having an open position for delivering refrigerant from the refrigerant tank to the refrigerant system, and a closed position for blocking the flow of refrigerant from the refrigerant tank to the refrigerant system;

a sensor for determining the amount of refrigerant in the refrigerant tank when in said housing and generating an amount signal representing the amount of refrigerant in the tank at selected times;

a system controller operatively connected with said tank valve for generating control signals to control said tank valve;

a computer readable medium in communication with said system controller; and a set of computer readable instructions in communication with said computer readable medium for operating said system during delivery of refrigerant to the refrigerant system including:

operating instructions for storing from said sensor an amount signal at a first selected time as an initial amount signal representing the amount of refrigerant initially in the tank, and transmitting an open signal to select said tank valve in said open position so that refrigerant is delivered to the refrigerant system;

said operating instructions transmitting a close valve signal to select said tank valve in said closed position so that the flow of refrigerant is blocked at a second selected time, and storing an amount signal from said sensor as a final amount signal representing the amount of refrigerant remaining in the tank at said second selected time;

a transaction file generated by said system controller containing amount data representing the amount of refrigerant delivered to the system indicated by the difference between said initial amount signal and said final amount signal, and said transaction file containing one or more of a location identity, a refrigerant system identity, a time and date of transaction, and a transaction ticket I.D.; and storing instructions for storing said transaction file in said computer readable medium;

whereby a refrigerant supply history may be maintained in computer storage for verifying vendor invoices and performance of the identified refrigerating system.

2. The system of claim 1 further comprising a data input device operatively associated with said system controller for inputting data into said computer readable medium.

3. The system of claim 2 wherein said inputted data represents instructions for executing said operating instructions on said system controller.

4. The system of claim 1 further comprising a display in communication with said controller for displaying said amount data representing the amount of refrigerant supplied to a refrigerant system to a user of the system.

5. The system of claim 1 wherein said housing includes a door moveable between an open position and a closed position; and including a door sensor for determining whether the door is in said closed position to generate a door closed signal allowing said tank valve to move to said open position.

6. The system of claim 1 wherein said computer readable instructions include transmission instructions for transmitting data representing the amount of refrigerant delivered to a remote computer readable medium for storage whereby accurate records of refrigerant use by refrigerant systems are maintained.

7. A system for monitoring the amount of refrigerant supplied from a refrigerant tank to a refrigerant system comprising:

a tank valve for connecting a refrigerant tank to a an identified refrigerant system at a predetermined location;

said tank valve having an open position for allowing the delivery of refrigerant from the tank to the refrigerant system and a closed position for blocking the flow of refrigerant from the tank to the refrigerant system;

a weighing device for determining the amount of refrigerant in the refrigerant tank at a given time and generating a weight signal representing the amount of refrigerant in the tank at that time; and a system controller operatively associated with said weighing device and said tank valve for storing an initial weight signal from said weighing device representing an initial amount of refrigerant in the tank, selecting said tank valve in said open position to deliver refrigerant from the tank to the refrigerant system, selecting said tank valve in said closed position, storing a final weight signal from said weighing device representing the amount of refrigerant remaining in the tank, determining the amount of refrigerant supplied to the refrigerant system as a function of said first and second weight; and a transaction file generated by said system controller containing amount data representing the amount of refrigerant supplied to the system, and said transaction file containing one or more of a location identity, a refrigerant system identity, a time and date of transaction, and a transaction ticket I.D. so that a refrigerant supply history may be maintained for verifying vendor invoices and performance of the identified refrigerant system.

8. The system of claim 7 including a display in communication with said controller for displaying said amount data representing the amount of refrigerant supplied to a refrigerant system to a user of the system.

9. The system of claim 7 wherein said controller includes a computer readable medium, a set of computer readable instructions in communication with said computer readable medium having operating instructions for operating said system during delivery of refrigerant to said refrigerant systems.

10. The system of claim 9 further comprising a housing wherein said housing includes a door moveable between an open position and a closed position; and including a door sensor for determining whether the door is closed to generate a door closed signal.

11. The system of claim 10 wherein said operating instructions include instructions for preventing the selection of said tank valve in said open position unless said door closed signal is received by the controller.

12. The system of claim 9 wherein said operating instructions include instructions for storing in said computer readable medium said amount data representing the amount of refrigerant supplied to a refrigerant system indicated by said controller and the time and date of the delivery of refrigerant to the refrigerant system.

13. The system of claim 9 including instructions for electronically transmitting said amount data representing the amount of refrigerant delivered to the refrigerant system, and the time and date of the delivery to a remote computer readable medium whereby accurate records of the refrigerant delivered to a system may be maintained.

14. The system of claim 9 including instructions for creating a transaction file containing the amount of refrigerant delivered to the refrigerant system, and the time and date of the delivery, and electronically transmitting said transaction file.

15. The system of claim 7 further comprising an input device operatively associated with said controller for allowing a user to input data representing instructions for operating said system controller.

16. A system for monitoring the amount of refrigerant supplied from a refrigerant tank to a refrigerant system comprising:

a tank valve for connecting a refrigerant tank to a refrigerant system at a predetermined location;

said tank valve having an open position for allowing the delivery of refrigerant from the tank to the refrigerant system and a closed position for blocking the flow of refrigerant from the tank to the refrigerant system;

a weighing device for determining the amount of refrigerant in the refrigerant tank at a given time and generating a weight signal representing the amount of refrigerant in the tank at that time; and a system controller operatively associated with said weighing device and said tank valve for storing an initial weight signal from said weighing device representing an initial amount of refrigerant in the tank, selecting said tank valve in said open position to deliver refrigerant from the tank to the refrigerant system, selecting said tank valve in said closed position, storing a final weight signal from said weighing device representing the amount of refrigerant remaining in the tank, determining the amount of refrigerant supplied to the refrigerant system as a function of said first and second weight signals, and storing amount data representing the amount of refrigerant supplied to the refrigerant system;

said controller including a computer readable medium, a set of computer readable instructions in communication with said computer readable medium having operating instructions for operating said system during delivery of refrigerant to said refrigerant systems; and said operating instructions include instructions for storing in said computer readable medium said amount data representing the amount of refrigerant supplied to a refrigerant system indicated by said controller, and data representing at least one of the date of the delivery of refrigerant to the refrigerant system and the identification of the refrigerant system.

* * * * *